US010352069B2

(12) United States Patent
Yamane et al.

(10) Patent No.: US 10,352,069 B2
(45) Date of Patent: Jul. 16, 2019

(54) LOCKING LEVER AND VEHICLE DOOR OPENING-CLOSING DEVICE

(71) Applicant: AISIN SEIKI KABUSHIKI KAISHA, Kariya-shi, Aichi-ken (JP)

(72) Inventors: Ryohei Yamane, Takahama (JP); Sadayuki Makino, Nagoya (JP)

(73) Assignee: AISIN SEIKI KABUSHIKI KAISHA, Kariya-Shi, Aichi-Ken (JP)

( * ) Notice: Subject to any disclaimer, the term of this patent is extended or adjusted under 35 U.S.C. 154(b) by 964 days.

(21) Appl. No.: 14/632,444

(22) Filed: Feb. 26, 2015

(65) Prior Publication Data

US 2015/0247346 A1 Sep. 3, 2015

(30) Foreign Application Priority Data

Feb. 28, 2014 (JP) ..... 2014-039752

(51) Int. Cl.
*E05B 79/08* (2014.01)
*E05B 79/10* (2014.01)
(Continued)

(52) U.S. Cl.
CPC ..... *E05B 79/10* (2013.01); *E05B 79/08* (2013.01); *E05B 77/32* (2013.01); *E05B 83/40* (2013.01);
(Continued)

(58) Field of Classification Search
CPC ..... Y10S 292/61
(Continued)

(56) References Cited

U.S. PATENT DOCUMENTS 5,067,758 A * 11/1991 Fann ..... E05B 3/065 292/244
5,666,833 A * 9/1997 Gao ..... E05B 3/065 292/336.3
(Continued)

FOREIGN PATENT DOCUMENTS

JP 10299313 A 11/1998
JP 2001-182401 A 7/2001
(Continued)

OTHER PUBLICATIONS

Office Action issued by the Japanese Patent Office dated Sep. 26, 2017 in corresponding Japanese Application No. 2014-039752, and English language translation of Office Action (6 pages).

*Primary Examiner* — Carlos Lugo
(74) *Attorney, Agent, or Firm* — Buchanan Ingersoll & Rooney PC

(57) ABSTRACT

A locking lever includes: a pair of lever pieces connected to each other to be relatively rotatable; and a spring member which extends about rotating axes of the lever pieces, of which both end portions engage with the lever pieces, and thereby, which biases the lever pieces to rotate in opposite directions, wherein contact portions, which come into contact with each other based on a biasing force of the spring member and thereby, are able to hold relatively rotating positions of the lever pieces, are provided in the lever pieces, respectively, wherein the spring member has spring end portions extending in a radial direction of the rotating shaft, and wherein an engagement surface with which the spring end portion comes into contact in a circumferential direction of the rotating shaft is provided on at least one of the lever pieces.

6 Claims, 16 Drawing Sheets

(51) Int. Cl.
*E05B 83/40* (2014.01)
*E05B 77/32* (2014.01)

(52) U.S. Cl.
CPC ..... *Y10S 292/61* (2013.01); *Y10T 74/20006* (2015.01)

(58) Field of Classification Search
USPC ..... 292/201, 216
See application file for complete search history.

(56) References Cited

U.S. PATENT DOCUMENTS 6,592,157 B1 * 7/2003 Spurr ..... E05B 85/01 292/201
7,021,681 B2 4/2006 Hayakawa et al.
7,137,657 B2 * 11/2006 Wu ..... E05B 15/02 292/357
7,175,211 B2 * 2/2007 Cetnar ..... E05B 17/0012 292/201
7,543,861 B2 * 6/2009 Dupont ..... E05B 83/36 292/216
7,559,586 B2 * 7/2009 Fukunaga ..... E05B 81/06 292/201
7,637,542 B2 * 12/2009 Suzumura ..... E05B 77/34 292/201
7,815,229 B2 10/2010 Ooe et al.
7,828,349 B2 * 11/2010 Chen ..... E05B 3/065 292/347
8,613,160 B2 12/2013 Matsumoto et al.
8,789,864 B2 * 7/2014 Chen ..... E05B 3/065 292/336.3
8,894,107 B2 * 11/2014 Kamata ..... B60N 2/01583 292/194

FOREIGN PATENT DOCUMENTS

JP 2006266026 A 10/2006
JP 2008-144402 A 6/2008
JP 2013-2233 A 1/2013

* cited by examiner

LOCKING LEVER AND VEHICLE DOOR OPENING-CLOSING DEVICE

CROSS REFERENCE TO RELATED APPLICATIONS

This application is based on and claims priority under 35 U.S.C. § 119 to Japanese Patent Application 2014-039752, filed on Feb. 28, 2014, the entire contents of which are incorporated herein by reference.

TECHNICAL FIELD

This disclosure relates to a locking lever and a vehicle door opening-closing device.

BACKGROUND DISCUSSION

Usually, a door opening-closing device for a vehicle such as a remote control device for a sliding door includes multiple lever members which are interlocked with a door handle of the vehicle (inside and outside door handle). In such a configuration, a locking mechanism provided in a vehicle door thereof is operated based on movements of these lever members.

In addition, a locking lever which is in cooperation with the lever members and can switch between locked states of the vehicle door is provided in such a door opening-closing device (for example, see JP 2008-144402A (Reference 1)).

As illustrated in FIG. 19 and FIG. 20, a locking lever 70 includes a first lever 71 and a second lever 72 which are connected to each other to be relatively rotatable and a spring member (torsion coil spring) 73 that biases both the first lever 71 and the second lever 72 such that the first and second levers rotate in a direction opposite to each other. In addition, contact portions 75 and 76 which come into contact with each other and thereby, enable both the first lever 71 and the second lever 72 to be held at relatively rotating positions are provided in the first lever 71 and the second lever 72. Accordingly, the locking lever 70 is configured to enable the first lever 71 and the second lever 72 to integrally rotate based on a biasing force of the spring member 73 and to enable the first lever 71 and the second lever 72 to relatively rotate against the biasing force of the spring member 73.

That is, for example, the locking lever 70 is configured such that the second lever 72 is driven in an unlocking direction based on a driving force of a locking actuator as in the door opening-closing device disclosed in Reference 1 and thereby, the first lever 71 rotates in the unlocking direction integrally with the second lever 72. Accordingly, a movement of the lever member connected to the door handle (outside) is transferred to the lever member connected to the locking mechanism and it is possible to enter into an unlocked state in which an operation of the door handle enables an opening movement of the vehicle door.

In addition, in the locking lever 70, even in a case where the second lever 72 is driven in a locking direction from such an unlocked state, the first lever 71 rotates in the locking direction integrally with the second lever 72. Accordingly, a movement of the lever member connected to the door handle is not transferred to the lever member connected to the locking mechanism and it is possible to enter into a locked state in which it is not possible to cause an operation of the door handle to enable an opening movement of the vehicle door.

Here, in a case where the door handle is operated before the rotating locking lever 70 moves to an unlock position, there is a possibility that the first lever 71 enters into a state of being confined to a non-rotatable manner. Even in such a case, it is possible for the second lever 72 to rotate in the unlocking direction against the biasing force of the spring member 73 present between the first lever 71 and the second lever 72.

That is, in this case, a user takes off a hand from the door handle and then the lever member connected to the door handle returns to its initial position and then, the first lever 71 moves to an unlock position based on the biasing force of the spring member 73 present between the second lever 72 and the first lever 71. Further, an interior locking operation member which is interlocked with the second lever 72 can normally perform an unlock operation. Accordingly, even when a problem of interference between the lock operation and such a door handle operation described above arises, it is possible to smoothly perform switching of the locked state.

In addition, in the example of the related art, the first lever 71, the second lever 72, and the spring member 73 which configure the locking lever 70 are integrally assembled in advance. Specifically, the locking lever 70 has a configuration in which a shaft 78 provided in the second lever 72 is inserted into a through-hole 77 provided in the first lever 71 and thereby, a rotating shaft thereof is formed. In addition, the spring member 73 is fitted into the shaft 78. In addition, both spring end portions 73*a* and 73*b* bent in an axial direction thereof are inserted into engagement holes 79 formed in the first lever 71 and the second lever 72, respectively, and thereby, the spring member 73 engages with the first lever 71 and the second lever 72. Accordingly, the first lever 71, the second lever 72, and the spring member 73 are integrally configured with each other and improvement of work efficiency thereof is achieved.

However, according to the configuration in the related art described above, the work of inserting each of the spring end portions 73*a* and 73*b* of the spring member 73 into the engagement holes 79 of the first lever 71 and the second lever 72 is complicated. This is the reason why improvement of the work efficiency is hindered and thus, there remains room for improvement.

SUMMARY

Thus, a need exists for a locking lever and a vehicle door opening-closing device which are not suspectable to the drawback mentioned above.

It is preferable that a locking lever according to an aspect of the disclosure includes: a pair of lever pieces connected to each other to be relatively rotatable; and a spring member which extends about rotating axes of the lever pieces, of which both end portions engage with the lever pieces, and thereby, which biases the lever pieces to rotate in opposite directions, contact portions, which come into contact with each other based on a biasing force of the spring member and thereby, are able to relatively hold rotating positions of the lever pieces, are provided in the lever pieces, respectively, the spring member has spring end portions extending in a radial direction of the rotating shaft, and an engagement surface with which the spring end portion comes into contact in a circumferential direction of the rotating shaft is provided on at least one of the lever pieces.

It is preferable that a vehicle door opening-closing device according to another aspect of the disclosure includes: the locking lever according to the aspect of this disclosure.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Hereinafter, an embodiment of a vehicle door opening-closing device that includes a locking lever will be described with reference to the drawings.

Figure 1:
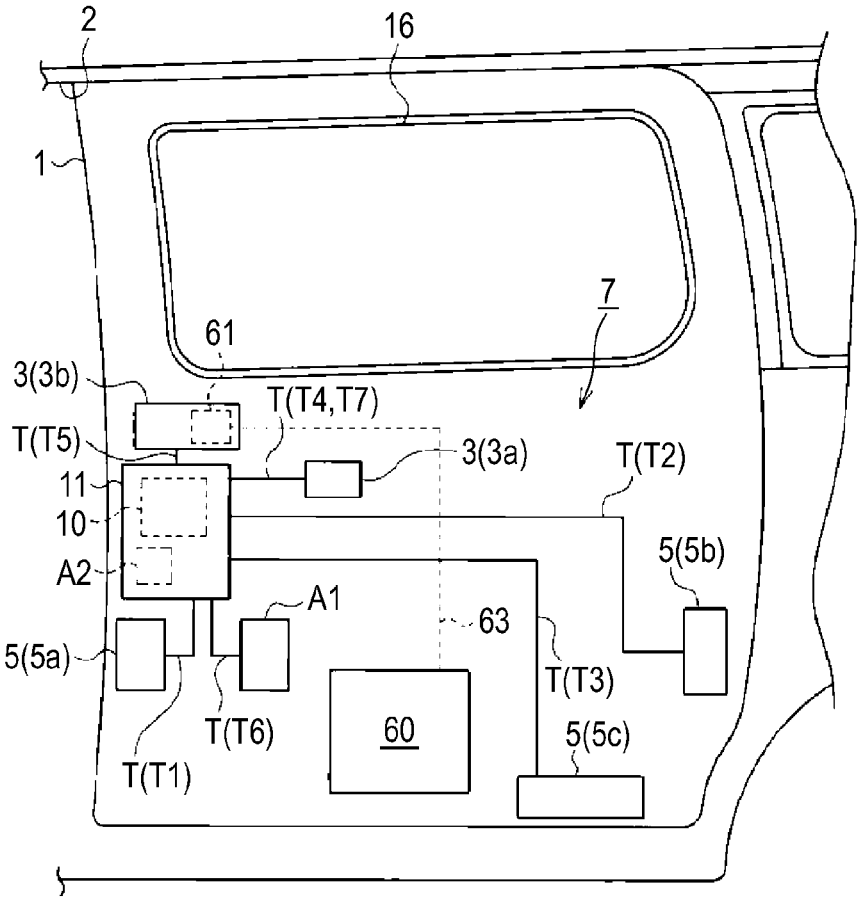
FIG. 1 is a view schematically illustrating a configuration of a door handle, a locking mechanism, and a remote control device provided in a sliding door.

As illustrated in FIG. 1, a sliding door 1 as a vehicle door moves in a front/rear direction and thereby, opens and closes a side opening 2 of a vehicle. That is, the sliding door 1 moves to the front side of the vehicle (in the drawing, left side) and thereby, enters into a closed state in which the side opening 2 is closed. The sliding door 1 moves to the rear side of the vehicle (in the drawing, right side) and thereby, enters into an opened state in which an occupant can get on and off through the side opening 2. An inside door handle 3*a* and an outside door handle 3*b* as operation members which are operated so as to open and close the sliding door 1 are provided on an exterior surface and on an interior surface of the sliding door 1, respectively.

In addition, a front lock 5*a* and a rear lock 5*b* (completely-closed lock) to confine the sliding door 1 to a completely-closed position, and a fully-opened lock 5*c* to confine the sliding door 1 to a fully-opened position are provided in the sliding door 1. An operation communicating system 7 that connects the door handles 3 and the locking mechanisms 5 via a communication member T such as a wire cable or a link is formed in the sliding door 1 of the present embodiment.

Specifically, a remote control device 11 that has a plurality of lever members 10 and relays the communication members T is provided at an intermediate portion of the operation communicating system 7. An appropriate locking mechanism 5 performs an unlock movement based on an operation input to the door handles 3 depending on the movement of the remote control device 11.

Figure 2:
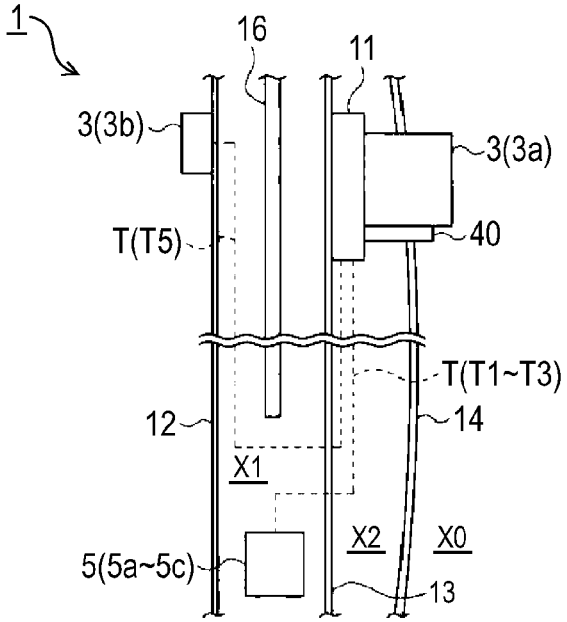
FIG. 2 is an explanatory view schematically illustrating a positional relationship between the door handle, a window glass, the remote control device, and the locking mechanism provided in the sliding door.

As illustrated in FIG. 2, the locking mechanisms 5 are disposed in an inside space X1 between an outer panel 12 and an inner panel 13 in the sliding door 1 of the present embodiment. In addition, the remote control device 11 is fixed to the inner panel 13 and thereby, is disposed in an inside space X2 between the inner panel 13 and a door trim 14. Further, the inside door handle 3*a* is supported by the remote control device 11 and thereby, is disposed in the interior space X0 in a state in which a front end thereof penetrates the door trim 14. A vertically movable window glass 16 is provided in the inside space X1 between the outer panel 12 and the inner panel 13. A communication member T (T5) of the outside door handle 3*b* is routed to the remote control device 11 in a state of detouring downward from the window glass 16 that moves vertically in the inside space X1.

Figure 3:
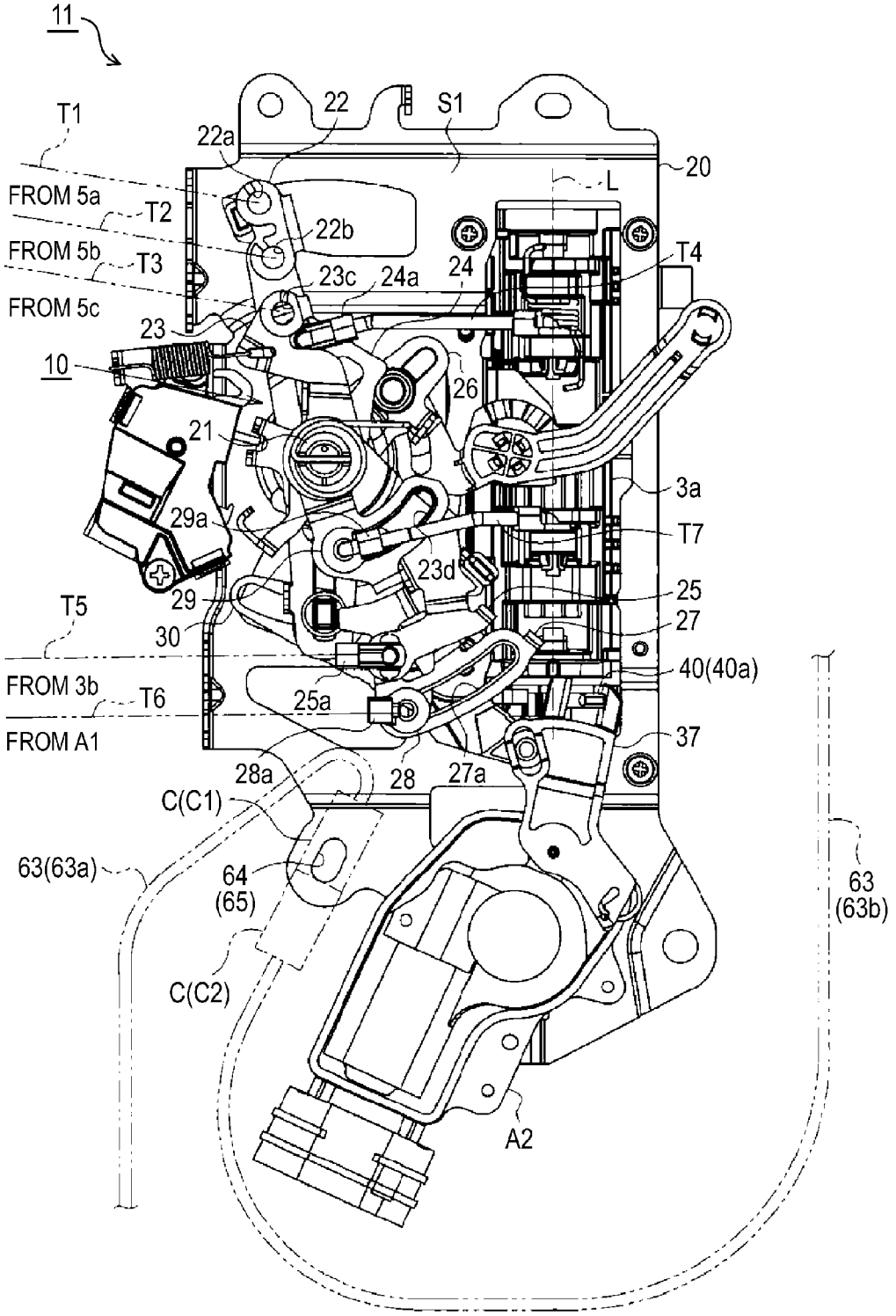
FIG. 3 is a front view of the remote control device.
Figure 4:
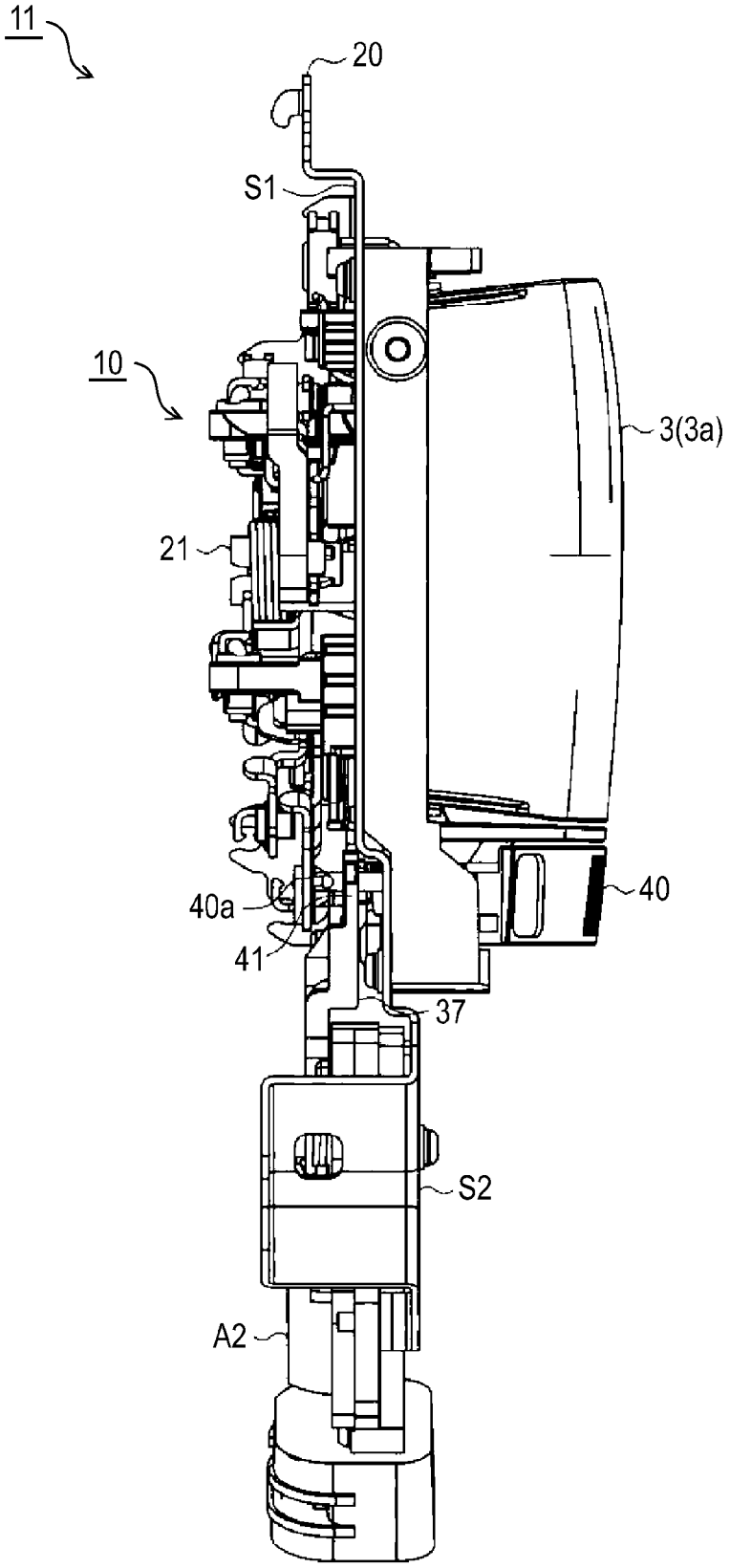
FIG. 4 is a side view of the remote control device.

As illustrated in FIG. 3 and FIG. 4, the remote control device 11 of the present embodiment includes a base bracket 20 which is fixed to the inner panel 13. In the present embodiment, the base bracket 20 is formed through plastic deformation (press forming) of a metal sheet. In addition, the proximal end portion of the inside door handle 3*a* is connected to the base bracket 20. Accordingly, the inside door handle 3*a* is configured to have a rotating shaft L extending vertically and to be supported by the base bracket 20.

In addition, the base bracket 20 has a support shaft 21 on a mounting surface S1 (in FIG. 4, left side surface) of the base bracket 20. The remote control device 11 of the present embodiment includes a plurality of lever members 10 which are rotatably supported by the support shaft 21.

As illustrated in FIG. 3, in the present embodiment, a completely-closed lock releasing lever 22 which has connection sections 22*a* and 22*b* connected to communication members T1 and T2 extending from the front lock 5*a* and the rear lock 5*b*, respectively, which configure the completely-closed lock and a fully-opened lock releasing lever 23 that has a connection section 23*c* connected to communication member T3 extending from the fully-opened lock 5*c* are supported by the support shaft 21. In addition, an inside lever 24 that has a connection section 24*a* connected to a communication member T4 extending from the inside door handle 3*a*, and an outside lever 25 that has a connection section 25*a* connected to a communication member T5 extending from the outside door handle 3*b* are supported by the support shaft 21. Further, an open lever 26 that can communicate movements of the inside lever 24 and the outside lever 25 to the completely-closed lock releasing lever 22 and the fully-opened lock releasing lever 23 is supported by the support shaft 21.

In addition, a release lever 27 that has a long hole 27*a* is supported by the support shaft 21. The remote control device 11 of the present embodiment includes a slide bush 28 that has a connection section 28*a* connected to a communication member T6 extending from a release actuator A1 and engages with the long hole 27*a* of the release lever 27.

Further, the remote control device 11 includes a slide bush 29 that has a connection section 29*a* connected to a communication member T7 extending from the inside door handle 3*a*. A long hole 23*d* that engages with the slide bush 29 is formed in an end portion of the fully-opened lock releasing lever 23 opposite to the connection section 23*c* across the support shaft 21.

The remote control device 11 of the present embodiment is configured such that the lever members 10 (22 to 27) which are supported by the support shaft 21 engage with each other and rotate by generating an operation input related to an opening and closing movement of the sliding door 1 via door handles 3 (3*a* and 3*b*) or other operating means. Engagement relationships between the lever members 10 are switched (switches) in accordance with the generated operation input and the operation input generating situation and thereby, it is possible to appropriately perform unlocking movements (and control the unlocking movements) of the locking mechanisms 5 (5*a* to 5*c*) connected via the communication members T (T1 to T3).

Figure 5:
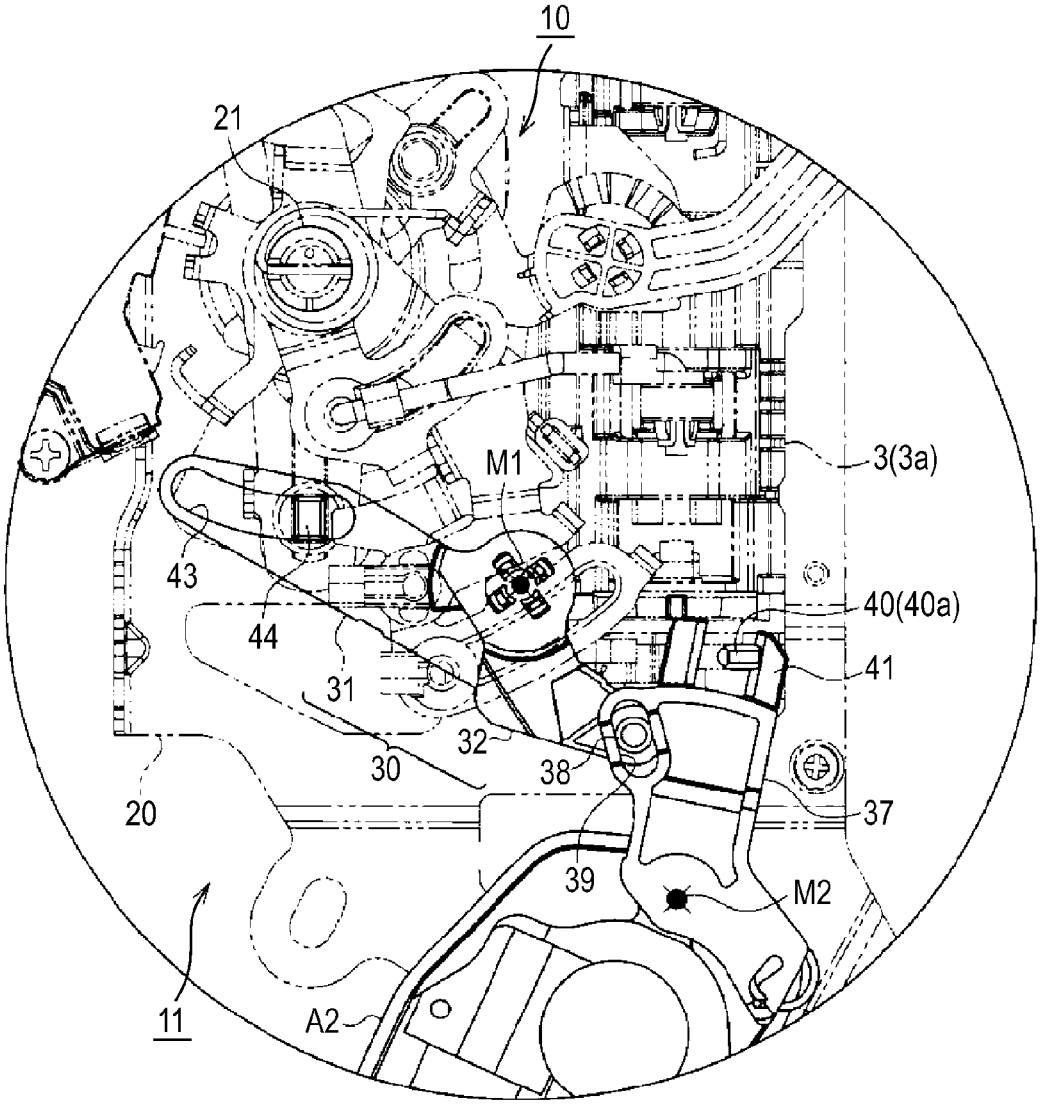
FIG. 5 is an enlarged view in the vicinity of a locking lever.

Specifically, as illustrated in FIG. 5, the remote control device 11 of the present embodiment includes a locking lever 30 that has a rotating shaft M1 which is different from the support shaft 21 and is supported by the base bracket 20. In the configuration, the engagement relationships between the lever members 10 which are supported by the support shaft 21 are switched based on a rotating position of the locking lever 30.

To be more exact, as illustrated in FIG. 6A to FIG. 9, the locking lever 30 of the present embodiment includes a first lever 31 and a second lever 32 which are connected to be relatively rotatable about the rotating shaft M1. A spring member 33 which biases the first lever 31 and the second lever 32 to rotate in directions opposite to each other is present between the first lever 31 and the second lever 32. Further, contact portions 35 and 36 which come into contact with each other based on a biasing force of the spring member 33 and thereby, enable a relatively rotating position to be held between the first lever 31 and the second lever 32 are provided in the first lever 31 and the second lever 32, respectively. Accordingly, the locking lever 30 of the present embodiment is configured such that the first lever 31 and the second lever 32 which share the rotating shaft M1 are integrally rotatable.

The remote control device 11 of the present embodiment is configured such that the locking lever 30 is disposed at a rotating position (unlock position) as illustrated in FIG. 3 and FIG. 5, and the outside lever 25 communicates the movement thereof to the completely-closed lock releasing lever 22. In addition, in the configuration, in the drawing, when the locking lever 30 is disposed at a rotated position (lock position) in a clockwise direction, the outside lever 25 does not communicate the movement thereof to the completely-closed lock releasing lever 22. Accordingly, in the present embodiment, the unlocked state in which completely closed locks (front lock 5*a* and rear lock 5*b* described above) can be released based on an operation of the outside door handle 3*b* and the locked state in which it is not possible to release the completely closed lock are switched with each other.

To be more exact, as illustrated in FIG. 3 and FIG. 5, in the present embodiment, a locking actuator A2 is provided at one end of the base bracket 20 (in the drawings, end section on the lower side). In addition, the locking actuator A2 includes an output lever 37 which has a rotating shaft M2 parallel to the rotating shaft M1 of the locking lever 30. The locking lever 30 of the present embodiment is connected to the locking actuator A2 via the output lever 37.

Specifically, the locking lever 30 of the present embodiment has an engagement pin 38 that is parallel to the rotating shaft M1 and protrudes from the mounting surface 51, in the tip of the second lever 32. A long hole 39 which engages with the engagement pin 38 is provided in the output lever 37.

In addition, as illustrated in FIG. 2 and FIG. 4, a lock operation member 40 which switches between the locked and unlocked states is provided in the sliding door 1 of the present embodiment. In the present embodiment, the lock operation member 40 is provided below the inside door handle 3*a* and thereby, is slidable in the vehicle frontward-rearward direction. Specifically, the lock operation member 40 is supported by the remote control device 11, more exactly, on the back surface S2 (in FIG. 4, surface on the right side) of the base bracket 20. Similar to the inside door handle 3*a*, the lock operation member 40 is disposed in the interior space X0 in a state in which the front end thereof penetrates the door trim 14.

Further, as illustrated in FIG. 4 and FIG. 5, the lock operation member 40 penetrates the base bracket 20 in the thickness direction and has a connection section 40*a* which protrudes to the mounting surface 51. An engagement section 41 with respect to the connection section 40*a* is provided in the output lever 37.

That is, the output lever 37 rotates based on the driving force of the locking actuator A2. In addition, the output lever 37 also rotates by operating the lock operation member 40. The locking lever 30 of the present embodiment is configured to be driven by the output lever 37 and thereby, to move (rotate) between the locked position and the unlocked position.

Figure 6A:
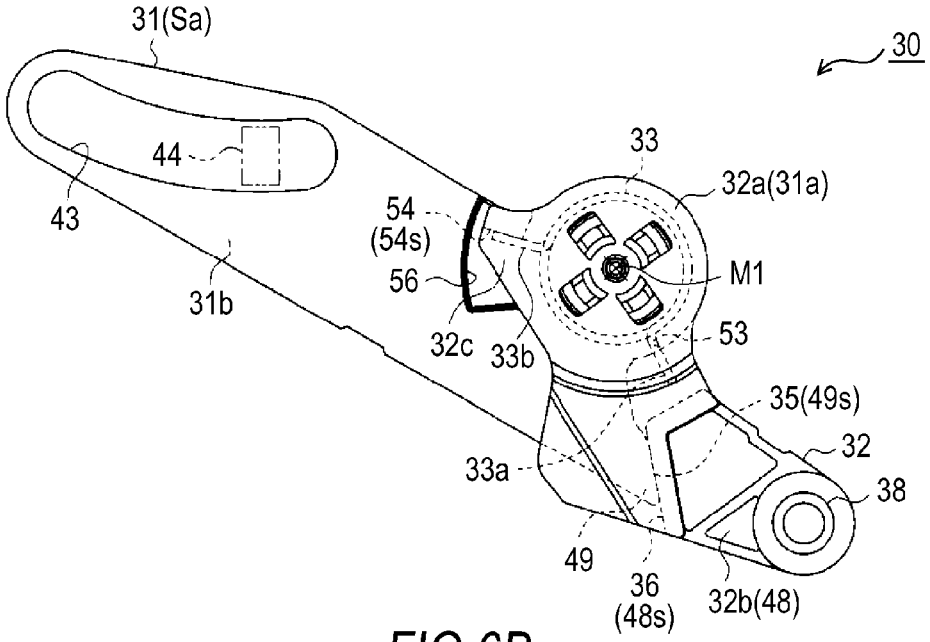
FIG. 6A is a front view of the locking lever and FIG. 6B is a front view of the locking lever (relatively rotating state)
Figure 6B:
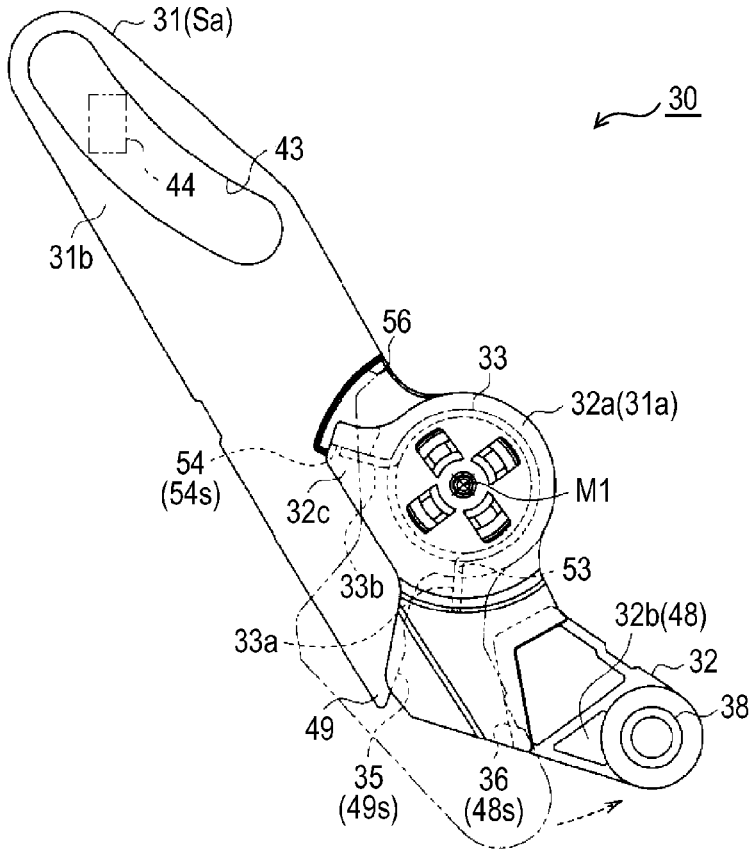

As illustrated in FIG. 5 and FIGS. 6A and 6B, in the locking lever 30 of the present embodiment, a substantially arc-shaped long hole 43 extending in a longitudinal direction thereof is formed in the first lever 31 disposed on the side opposite to the second lever 32 across the rotating shaft M1, that is, on the side of the lever members 10 supported by the support shaft 21. In addition, an engagement member 44 which is movable in the long hole 43 is provided to engage with the long hole 43. The locking lever 30 of the present embodiment rotates about the rotating shaft M1 and thereby, causes the engagement member 44 which engages with the long hole 43 of the first lever 31 to move in a contact/separation direction (in FIG. 5, vertical direction) with respect to the support shaft 21. Accordingly, the remote control device 11 of the present embodiment is configured such that the engagement relationships between the lever members 10 supported by the support shaft 21 are switched with each other.

In addition, as illustrated in FIG. 6B, the locking lever 30 of the present embodiment is configured such that the first lever 31 and the second lever 32 are relatively rotatable against the biasing force of the spring member 33. Accordingly, in the remote control device 11 of the present embodiment, the interference between the operation input with respect to the outside door handle 3*b* and an operation of the locking actuator A2 is suppressed.

That is, in a case where the outside door handle 3*b* is operated before the locking lever 30 driven by the output lever 37 moves to the unlocked position, there is a possibility that the first lever 31 enters into a state of being confined non-rotatably by the lever members 10 supported by the support shaft 21.

However, even in such a situation, the second lever 32 is rotatable against the biasing force of the spring member 33 in the unlocking direction. That is, a user takes off a hand from the outside door handle 3*b* and then, in a stage of releasing restraints by the lever members 10, the first lever 31 is rotatable in the unlocking direction based on the biasing force of the spring member 33. Accordingly, in the present embodiment, smooth switching to a locked state is secured.

Configuration of Assembly of Locking Lever

Next, an assembly structure of the locking lever 30 will be described.

As illustrated in FIG. 7A to FIG. 9, in the present embodiment, a shaft 46 provided on the second lever 32 is inserted into a through-hole 45 formed in the first lever 31 such that the rotating shaft M1 of the locking lever 30 is formed. In addition, a torsion coil spring 47 which can insert the shaft 46 in a coil portion thereof is used as the spring member 33 of the present embodiment. The locking lever 30 of the present embodiment is configured to be attached to the mounting surface S1 of the base bracket 20 in a state in which the first lever 31, the second lever 32, and the spring member 33 are integrally assembled.

To be more exact, as illustrated in FIGS. 10A and 10B and FIGS. 11A and 11B, in the present embodiment, the first lever 31 and the second lever 32 include connection sections 31*a* and 32*a* formed substantially in a disk shape, respectively. Thus, the through-hole 45 and the shaft 46 are formed at the center of the connection sections 31*a* and 32*a*.

In addition, the first lever 31 and the second lever 32 include substantially flat plate-shaped and elongated lever main bodies 31*b* and 32*b*, respectively, which are provided in shapes offsetting outward in a radial direction of the connection sections 31*a* and 32*a*. Thus, the long hole 43 and the engagement pin 38 are provided at the tip end portions of the lever main bodies 31*b* and 32*b*.

Figure 7A:
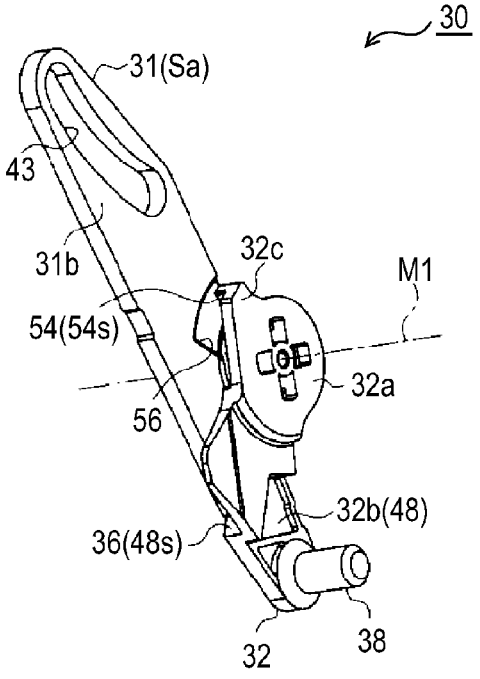
FIGS. 7A and 7B are perspective views of the locking lever.
Figure 7B:
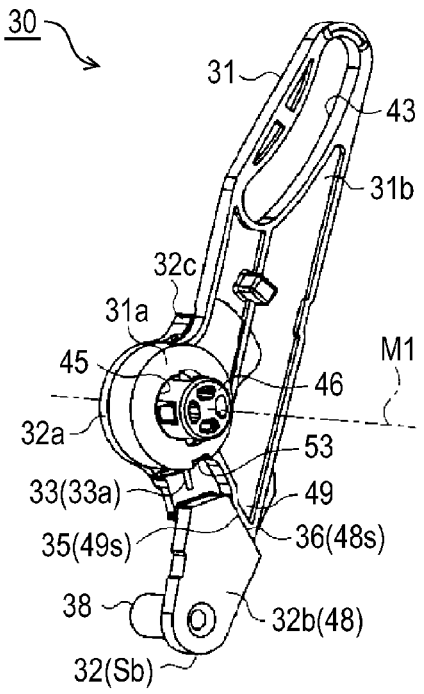

Here, in the second lever 32 of the present embodiment, the tip end side (of the lever main body 32*b*) in which the engagement pin 38 is provided becomes a step section 48 which protrudes in a protruding direction (in FIG. 11A, on the right side) of the shaft 46, that is, on the rear surface Sb of the second lever 32. Further, as illustrated in FIGS. 7A and 7B, the second lever 32 is assembled with the first lever 31 such that the step section 48 rotates on the same plane with the lever main body 31*b* of the first lever 31. In the present embodiment, the side-end surface 48*s* of the step section 48 is disposed at a coincident position to a side-end surface of the lever main body 31*b* of the first lever 31, more exactly, to a side-end surface 49*s* of a hornlike section 49 protruding to the proximal end side in the circumferential direction. That is, both of the side-end surfaces 48*s* and 49*s* are formed to configure the contact portions 35 and 36 on the first lever 31 side and on the second lever 32 side respectively.

Figure 8:
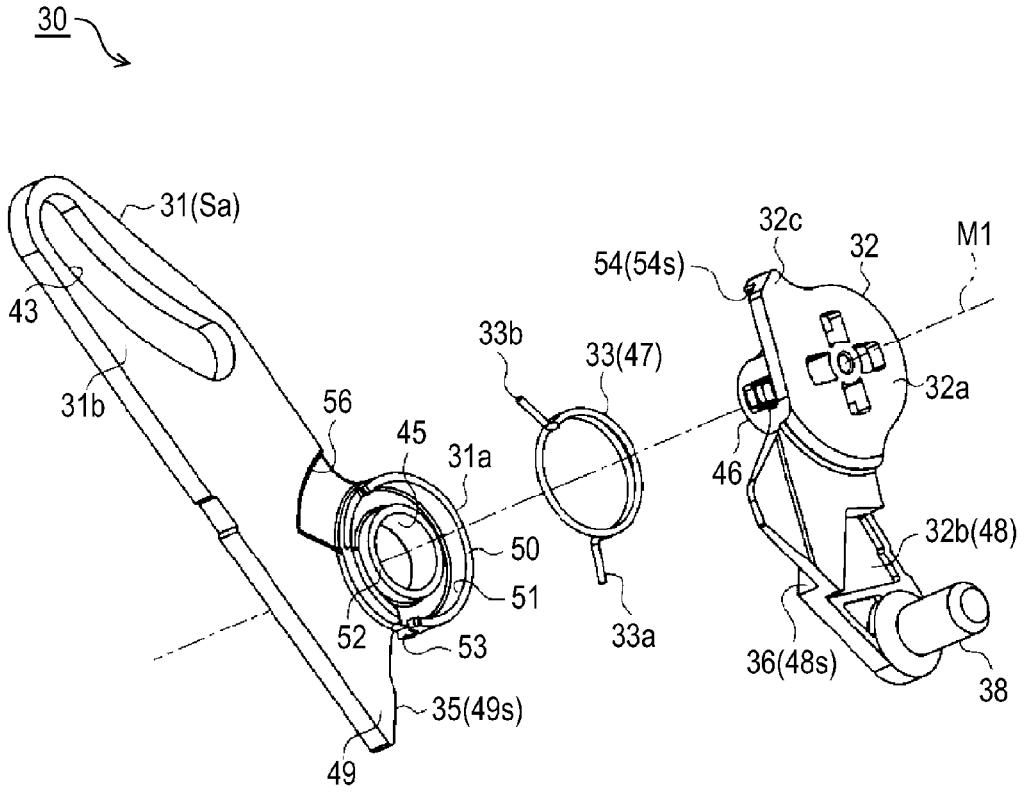
FIG. 8 is an exploded perspective view of the locking lever.
Figure 9:
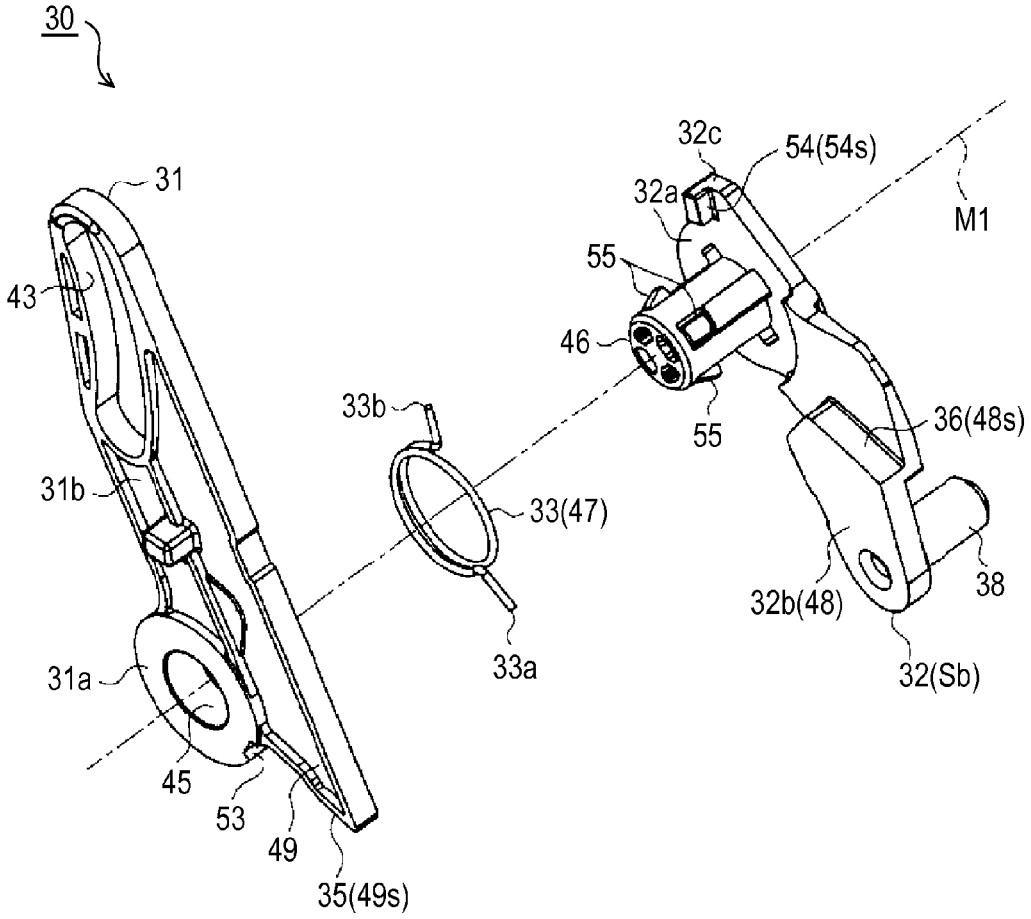
FIG. 9 is an exploded perspective view of the locking lever.

In addition, as illustrated in FIG. 8 and FIG. 9, the spring member 33 of the present embodiment has spring end portions 33*a* and 33*b* which extend outward in the radial direction of the shaft 46 in a mounted state with respect to the shaft 46. Specifically, in a case where one end side of both of the spring end portions 33*a* and 33*b* of the spring member 33 is disposed on the upper side and the other side is disposed on the lower side, the spring member 33 has a shape such that an exterior appearance (for example, side view, plan view, or the like) obtained by inverting both of the spring end portions 33*a* and 33*b* upside down is substantially the same as the exterior appearance before the inverting. Thus, both of the spring end portions 33*a* and 33*b* engage with the first lever 31 and the second lever 32, respectively, such that it is possible to generate a spring force (elastic restoring force) which enables the first lever 31 and the second lever 32 to rotate and be biased in directions opposite to each other.

Figure 12:
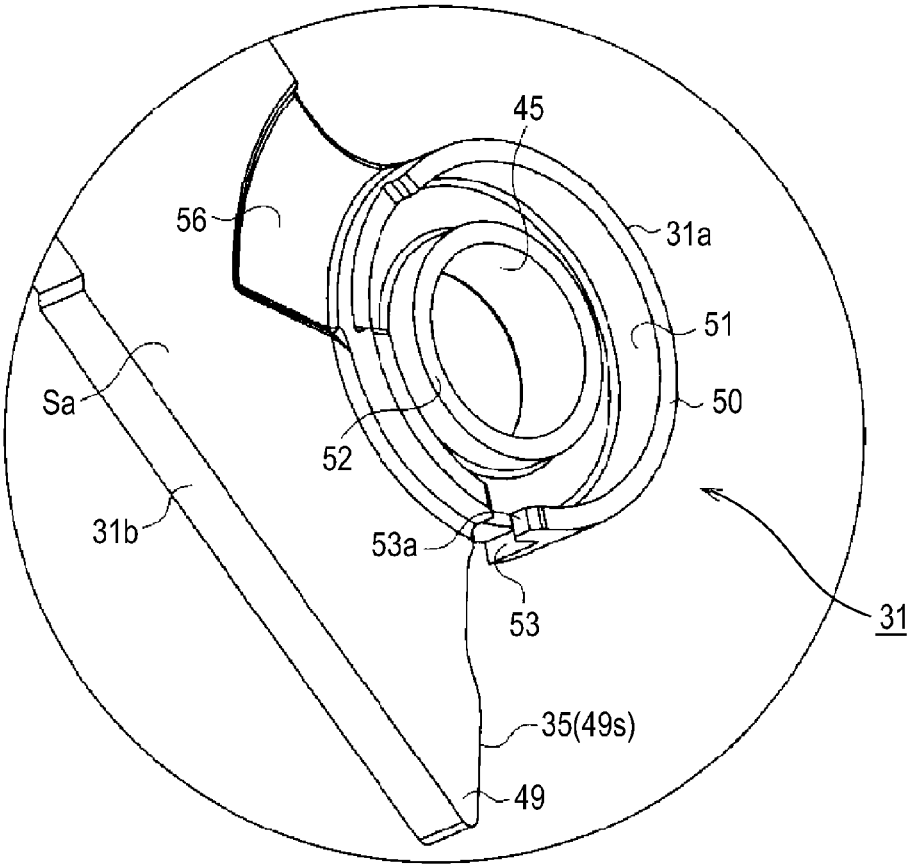
FIG. 12 is an enlarged view in the vicinity of a through-hole formed in the first lever.

To be more exact, as illustrated in FIG. 8 and FIG. 12, in the present embodiment, a circumferential wall section 50 is formed in the connection section 31*a* of the first lever 31 along an outer circumferential edge thereof. Thus, a substantially cylindrical guide section 52 which can guide the shaft 46 to be inserted into the through-hole 45 is formed on the circumferential edge of the through-hole 45.

In the present embodiment, the circumferential wall section 50 surrounds the outer side in the radial direction of the spring member 33 (coil section of the torsion coil spring 47) fit in the shaft 46 such that an accommodation section 51 of the spring member 33 is formed between the connection section 32*a* of the second lever 32 and the circumferential wall section 50. Thus, the circumferential wall section 50 is notched such that a latching portion 53 which can latch the spring end portion 33*a* of the spring member 33 undetachably is formed.

Figure 10A:
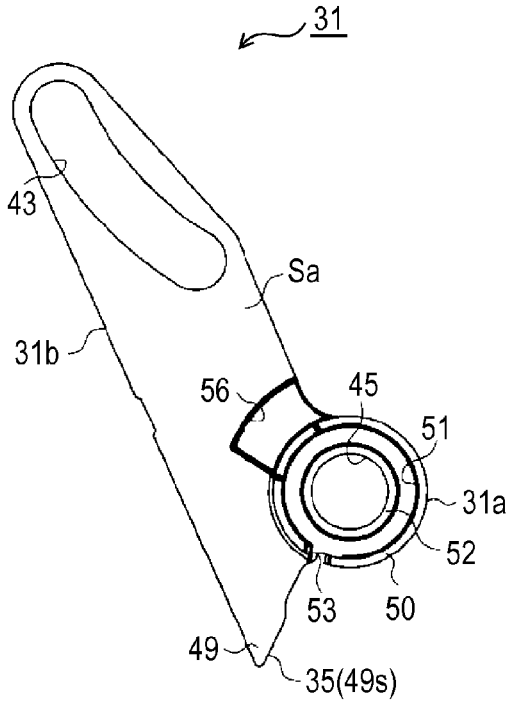
FIG. 10A is a front view of a first lever (surface) and FIG. 10B is a side view of the first lever.
Figure 10B:
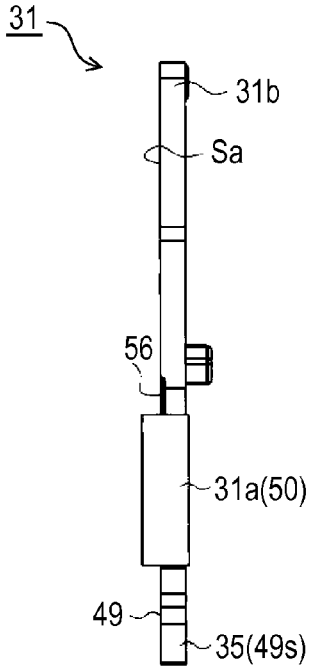
Figure 11A:
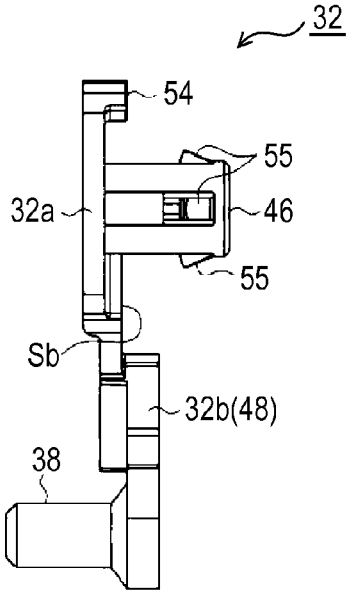
FIG. 11A is a side view of a second lever and FIG. 11B is a rear view of the second lever (rear surface)
Figure 11B:
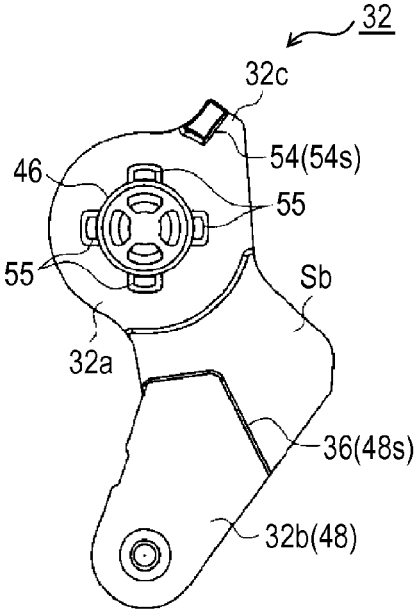

Specifically, the latching portion 53 is formed so as to open in the axial direction of the shaft 46 (refer to FIG. 10A, front side from the paper surface). In addition, a protrusion 53*a* which protrudes in the circumferential direction is provided on the opening end. Accordingly, in the present embodiment, a latching mechanism (labyrinthine structure) is formed and can prevent the spring end portion 33*a* engaging with the latching portion 53 from detaching.

That is, the spring member 33 of the present embodiment is assembled with the first lever 31 in the axial direction of the shaft 46 integrally with the second lever 32 in a state in which the spring end portion 33*a* coincides with a position of the latching portion 53 in the circumferential direction. In addition, the spring end portion 33*a* inserted into the latching portion 53 engages with one end side (in FIG. 12, side-end portion positioned in a counterclockwise direction) in the latching portion 53 in the circumferential direction based on the biasing force of the spring member 33. In the present embodiment, the protrusion 53*a* is provided at a position in the circumferential direction with which the spring end portion 33*a* engages. Accordingly, the latching portion 53 of the present embodiment can prevent the spring end portion 33*a* from detaching in the axial direction of the shaft 46.

Figure 13:
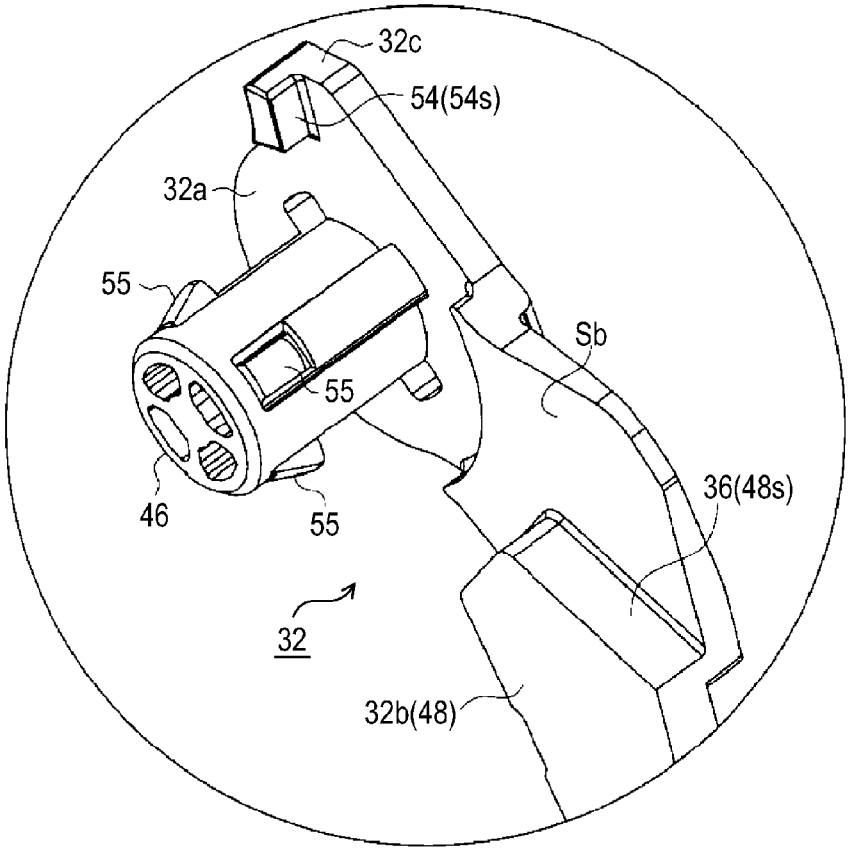
FIG. 13 is an enlarged view in the vicinity of a shaft provided on the second lever.

As illustrated in FIG. 9 and FIG. 13, when the first lever 31 and the second lever 32 are assembled, an engagement protrusion 54 protruding from the rear surface Sb of the second lever 32 which faces the surface Sa of the first lever 31 is formed toward the first lever 31 side. Thus, in the present embodiment, the first lever 31 and the second lever 32 are configured such that the spring end portion 33*b* of the spring member 33 engages with the engagement protrusion 54.

To be more exact, the second lever 32 of the present embodiment includes a substantially disk-shaped overhanging section 32*c* which protrudes outward in the radial direction from the connection section 32*a*. Specifically, the overhanging section 32*c* is formed to protrude in a direction opposite to the lever main body 32*b* across the rotating shaft M1. Thus, the engagement protrusion 54 is provided on the rear surface Sb of the overhanging section 32*c*.

In addition, the engagement protrusion 54 has an engagement surface 54*s* on a side opposite to the contact portion 36 on the second lever 32 in the circumferential direction of the rotating shaft M1, that is, on the side opposite to the side-end surface 48*s* of the step section 48. The spring end portion 33*b* of the spring member 33 engages with the engagement protrusion 54 in a state in which the spring end portion 33*b* comes into contact with the engagement surface 54*s* in the circumferential direction.

Next, an assembly procedure of the locking lever 30 according to the present embodiment will be described.

Figure 14:
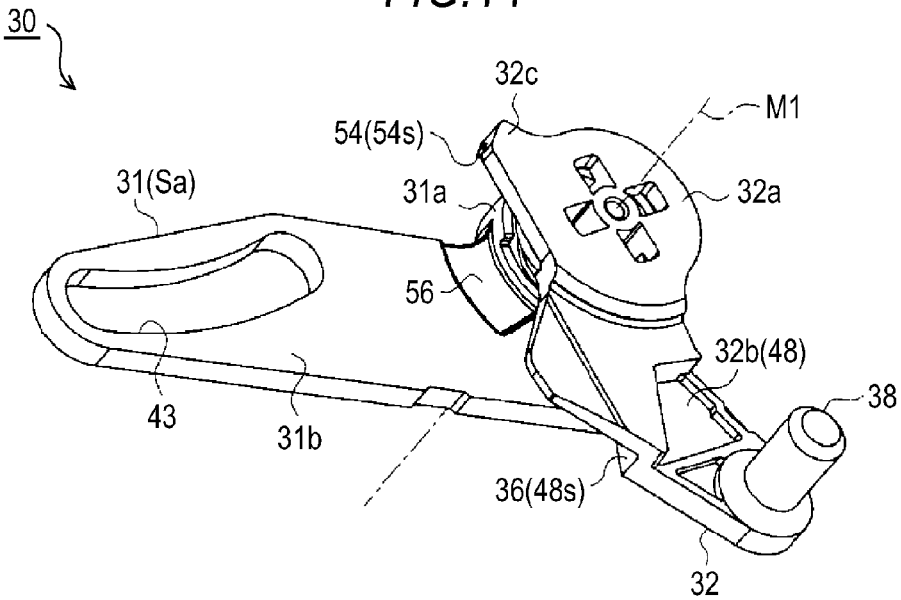
FIG. 14 is a perspective view of the locking lever (during assembly)
Figure 15:
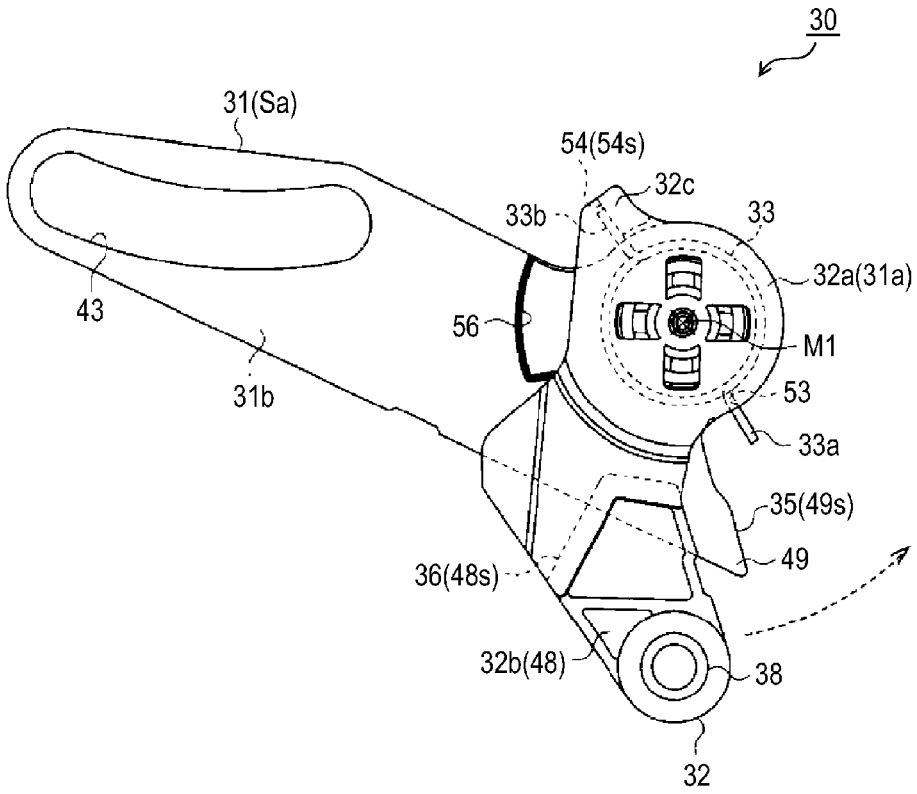
FIG. 15 is an explanatory view illustrating an assembly procedure of the locking lever.
Figure 16:
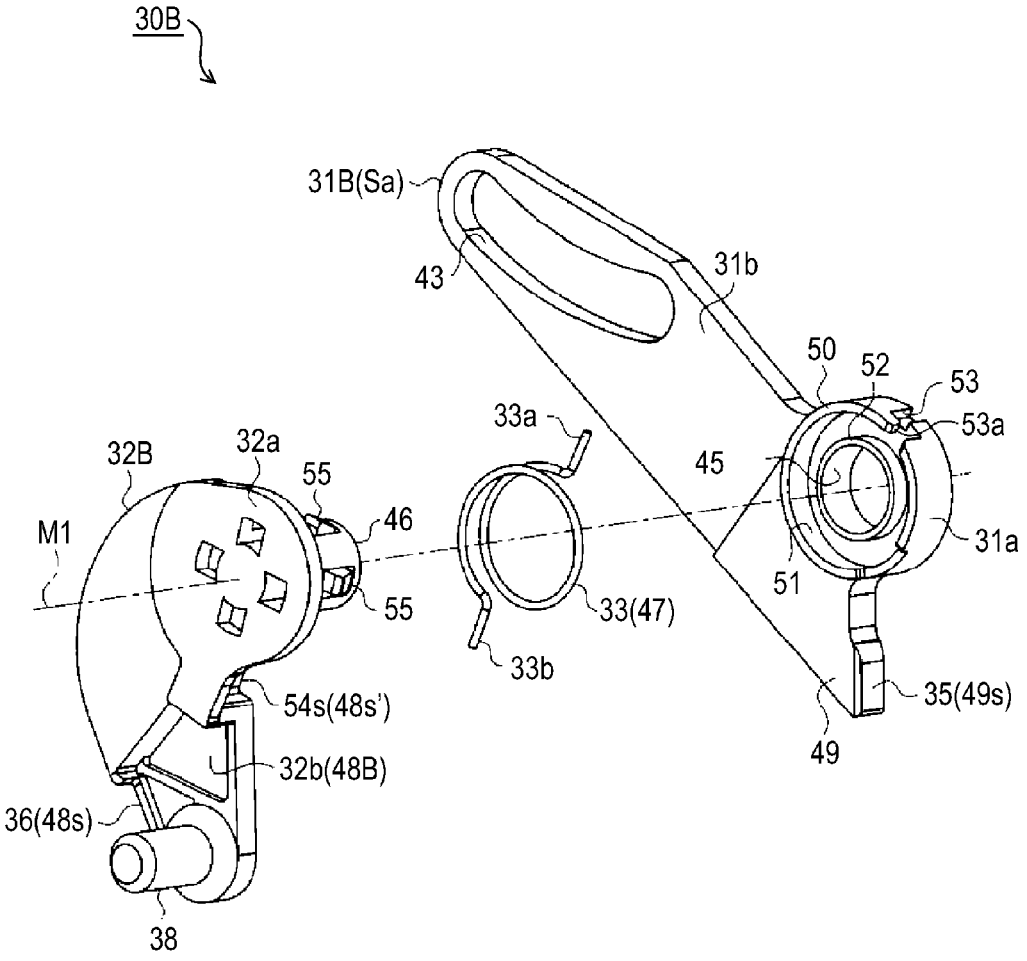
FIG. 16 is an exploded perspective view of a locking lever of another example.
Figure 17A:
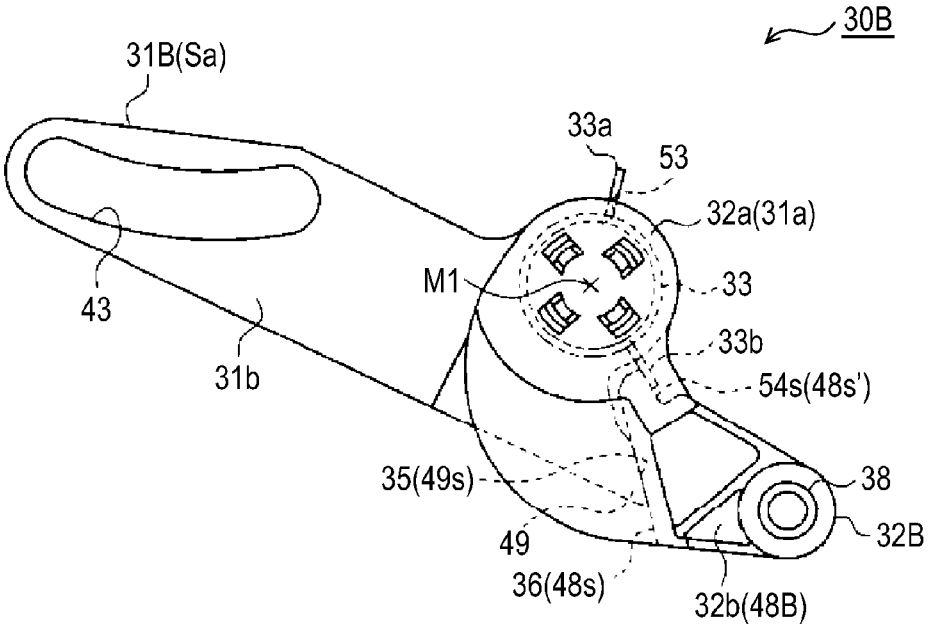
FIG. 17A is a front view of the locking lever of the other example and FIG. 17B is a side view of the locking lever of the other example.
Figure 17B:
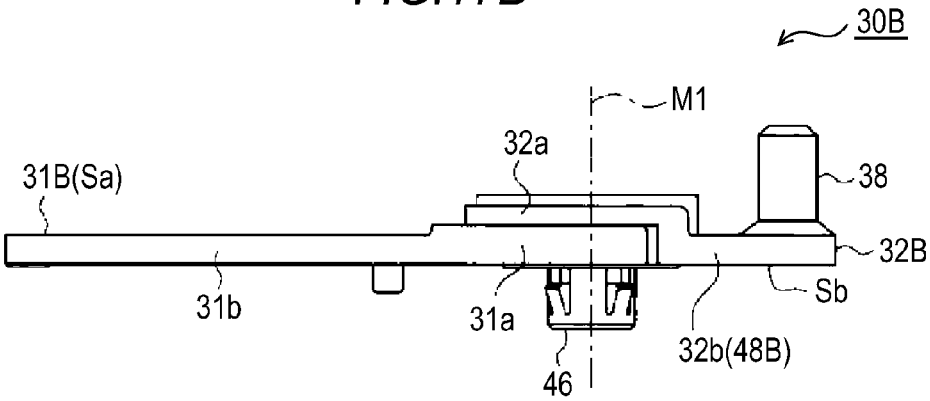
Figure 18A:
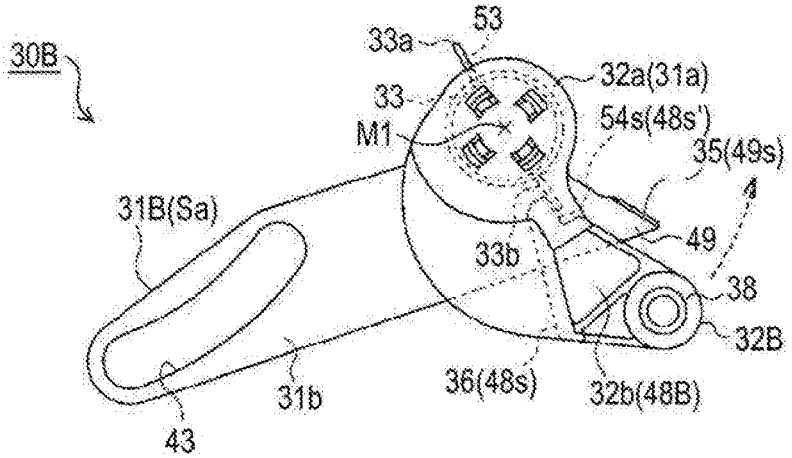
FIG. 18A is a front view of the locking lever of the other example (during assembly) and FIG. 18B is a side view of the locking lever of the other example (during assembly)
Figure 18B:
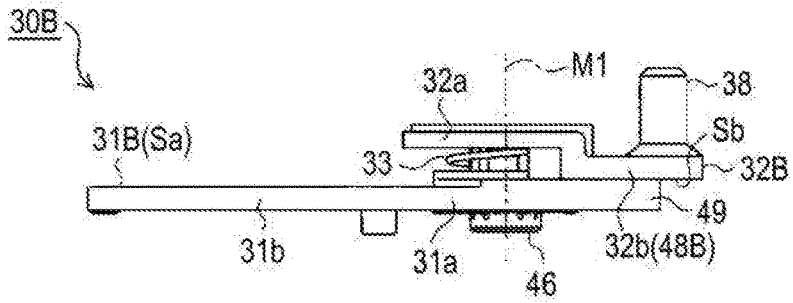

As illustrated in FIG. 14 and FIG. 15, in the present embodiment, when the shaft 46 on the second lever 32 side is inserted into the through-hole 45 of the first lever 31, the step section 48 comes into contact with a facing surface (surface Sa) on the first lever 31 such that the first lever 31, the second lever 32, and the spring member 33 are assembled.

At this time, the spring member 33 of the present embodiment is configured such that the spring end portion 33*a* of the spring member 33 of the present embodiment is inserted to the latching portion 53 of the first lever 31, and the other spring end portion 33*b* is disposed at the coincident position with the engagement surface 54*s* of the second lever 32 in the circumferential direction.

Further, in the present embodiment, the first lever 31 and the second lever 32 relatively rotate from the state. Specifically, in FIG. 15, the second lever 32 is caused to rotate in the counterclockwise direction with respect to the first lever 31 such that torsion is applied to the spring member 33 and the contact portions 35 and 36 of the first lever 31 and the second lever 32 are caused to move to a position at which the contact portions 35 and 36 can come into contact with each other.

That is, in the second lever 32 of the present embodiment, the step section 48 which slides on the surface Sa of the first lever 31 is detached from the surface Sa such that the side-end surface 48*s* that configures the contact portion 36 is disposed at a position in the circumferential direction so as to face the side-end surface 49*s* of the hornlike section 49 which configures the contact portion 35 of the first lever 31. In addition, at the time, the spring member 33 is twisted by being pressed against the engagement surface 54*s* of the second lever 32 which rotates in the circumferential direction and the spring force (biasing force) is generated such that the second lever 32 is caused to rotate in an opposite direction (in FIG. 15, a clockwise direction). In the present embodiment, an insertion amount of the shaft 46 is adjusted in the state and the contact portions 35 and 36 of the first lever 31 and the second lever 32 are caused to coincide with each other at a position in the axial direction such that the contact portions 35 and 36 come into contact with each other. That is, both of the contact portions 35 and 36 press against each other based on the spring force of the spring member 33 such that the relatively rotating position of the first lever 31 and the second lever 32 are held.

As illustrated in FIG. 7B and FIG. 13, in the present embodiment, a plurality of engagement protrusions 55 which has flexibility and widens toward the proximal end side from the distal end side is provided at the distal end of the shaft 46. Thus, the engagement protrusions 55 engage with the circumferential edge section of the through-hole 45 at a position at which the contact portions 35 and 36 of the first lever 31 and the second lever 32 can come into contact with each other and are inserted, such that the relative movement of the shaft 46 along the axial direction, to be more exact, the relative movement of the first lever 31 and the second lever 32 in a direction in which the shaft 46 is pulled out of the through-hole 45 is controlled.

In addition, as illustrated in FIGS. 6A and 6B, in the first lever 31 of the present embodiment, in a state of assembly as the locking lever 30, the latching portion 53 is formed at a position at which the spring end portion 33*a* latched on the latching portion 53 is covered by the second lever 32. Further, the overhanging section 32*c* on the second lever 32 side also functions as a protect portion which covers the spring end portion 33*b* by disposing the spring end portion 33*b* which comes into contact with the engagement surface 54*s* of the engagement protrusions 54 provided on the rear surface Sb side between the surface Sa of the first lever 31 and the overhanging section 32*c*. A concave portion 56 so as to avoid interfering with the engagement protrusion 54 and the spring end portion 33*b* is formed on the surface Sa of the first lever 31. Accordingly, in the present embodiment, both of the spring end portions 33*a* and 33*b* are configured so as not to protrude from the outline of both of the first lever 31 and the second lever 32 in a view of axial direction of the rotating shaft M1.

Configuration of Holding of Wiring Harness

Next, a holding structure of a wiring harness in the remote control device 11 of the present embodiment will be described.

As illustrated in FIG. 1, in the sliding door 1 of the present embodiment, a power sliding door device 60 which enables the sliding door 1 to perform the opening/closing movement by the motor drive is provided. In addition, a switch unit 61 causes the locking mechanisms 5 (5*a* and 5*b*) to perform an unlocking movement and is operated so as to cause the power sliding door device 60 to move is provided in the outside door handle 3*b*. Thus, a wiring harness 63 which electrically connects the power sliding door device 60 and the switch unit 61 is routed inside the sliding door 1.

To be more exact, the wiring harness 63 of the present embodiment is routed (refer to FIG. 2) in a state of detouring below of the window glass 16 which moves vertically in the inside space X1 between the outer panel 12 and the inner panel 13, similar to the communication member T (T5) of the outside door handle 3*b*. In addition, as illustrated in FIG. 3, the wiring harness 63 of the present embodiment is configured to connect the first connection line 63*a* extending from the power sliding door device 60 and a second connection line 63*b* extending from the switch unit 61 via connectors C (C1 and C2) which are provided at an intermediate portion. A holding section 64 which holds (clamps) the connectors C (C1 and C2) which are provided at an intermediate portion of the wiring harness 63 is provided in the remote control device 11 of the present embodiment.

Further, to be more exact, in the remote control device 11 of the present embodiment, a through-hole 65 is formed at one end (in the drawing, end portion on the lower side) of the base bracket 20. In addition, in the present embodiment, the first connector C1 provided at the distal end of the first connection line 63*a* engages with the through-hole 65. Thus, the wiring harness 63 of the present embodiment causes the second connector C2 provided at the distal end of the second connection line 63*b* to be fit to the first connector C1 on the first connection line 63*a* thereby, the power sliding door device 60 and the switch unit 61 are configured to be electrically connected to each other.

That is, in the present embodiment, the through-hole 65 provided on the base bracket 20 functions as the holding section 64 of the connectors C (C1 and C2). Accordingly, the wiring harness 63 of the present embodiment is routed inner side of the sliding door 1 in a state where an intermediate portion which connects the power sliding door device 60 and the switch unit 61 is held in the remote control device 11.

Hereinafter, according to the present embodiment, it is possible to obtain the following effects.

(1) The locking lever 30 includes the first lever 31 and the second lever 32 as a pair of lever pieces which are connected relatively rotatable, and a spring member 33 of which both spring end portions 33*a* and 33*b* are engaged with the first lever 31 and the second lever 32 and which biases the first lever 31 and the second lever 32 to rotate in directions opposite to each other. In addition, contact portions 35 and 36, which come into contact with each other and thereby, are able to hold relatively rotating positions of the first lever 31 and the second lever 32, are provided in the first lever 31 and the second lever 32, respectively. Further, the spring member 33 has the spring end portion 33*b* extending in a radial direction of the rotating shaft M1. An engagement surface 54*s* with which the spring end portion 33*b* comes into contact in a circumferential direction is provided on the second lever 32.

Figure 19:
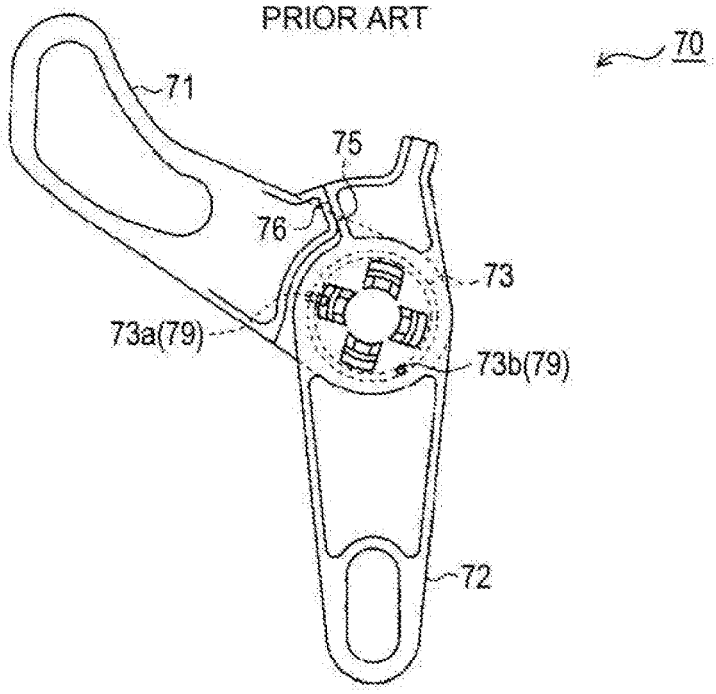
FIG.19 PRIOR ART
FIG. 19 is a front view of a locking lever in the related art.
Figure 20:
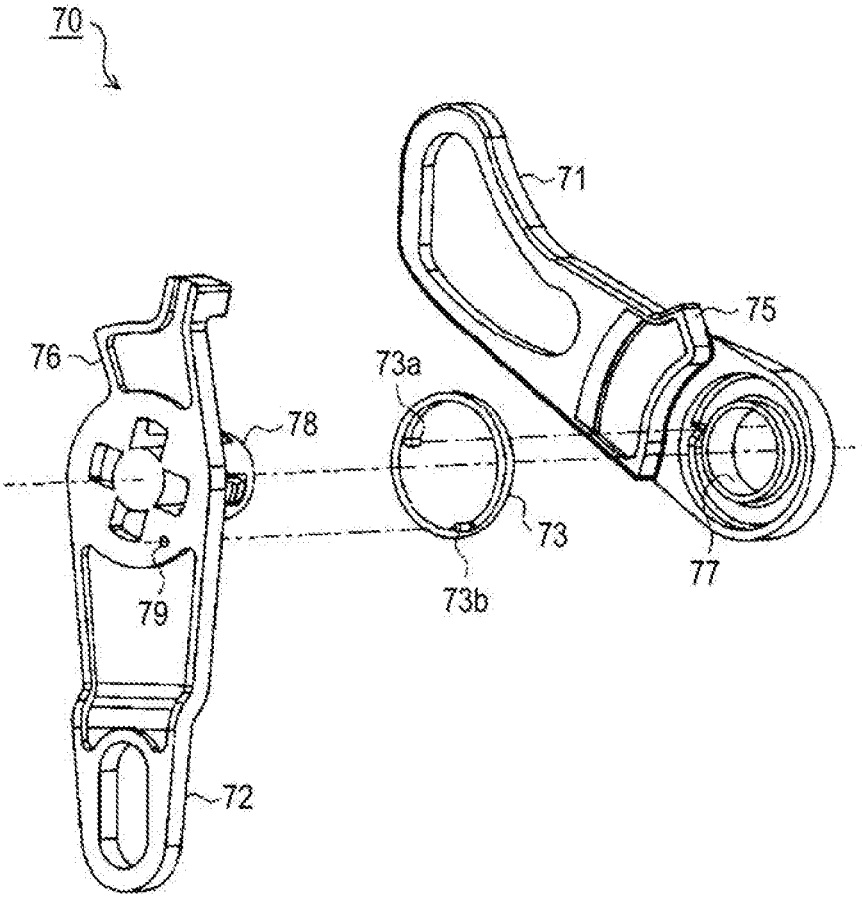
FIG.20 PRIOR ART
FIG. 20 is an exploded perspective view of the locking lever in the related art.

According to the configuration, both the first lever 31 and the second lever 32 are caused to relatively rotate and thereby, it is possible to easily engage the spring end portion 33*b* with the second lever 32. Further, both the first lever 31 and the second lever 32 are caused to relatively rotate in a state in which the spring end portion 33*b* comes into contact with the engagement surface 54*s*, torsion is applied to the spring member 33, and thereby, it is possible to generate the biasing force to the spring member 33 in a direction in which both the first lever 31 and the second lever 32 are caused to rotate in a direction opposite to the relatively rotating directions, that is, the biasing force in a direction in which the contact portions 35 and 36 come into contact with each other. In addition, at this time, the spring end portion 33*b* comes into contact with the engagement surface 54*s* in the circumferential direction and thereby, there is an advantage in that the spring end portion 33*b* is unlikely to be detached from the engagement surface 54*s*. Accordingly, for example, it is possible to simplify the assembly work, compared to the related art in which both of the spring end portions 73*a* and 73*b* of the spring member 73 which is bent in the axial direction as illustrated in FIG. 19 and FIG. 20 are inserted into the engagement holes 79 provided on the first lever 71 and the second lever 72. As a result, it is possible to improve work efficiency.

(2) In the locking lever 30, both of the spring end portions 33*a* and 33*b* of the spring member 33 extend in the radial direction. That is, by employing such a spring member 33, it is possible to eliminate the task of verifying the front and rear relationship, that is, which spring end portion corresponds to any one of the first lever 31 and the second lever 32. Accordingly, it is possible to further simplify the assembly work.

(3) A latching portion 53 on which the one spring end portion 33*a* is latched is formed in the first lever 31. The latching portion 53 causes the spring end portion 33*a* to be inserted into the axial direction of the rotating shaft M1 and has a latching mechanism (labyrinthine structure) in which it is possible to prevent the spring end portion 33*a* from being detached in the axial direction.

That is, at the time of assembly, the one spring end portion 33*a* is latched to the first lever 31 undetachably and it is possible to safely hold the spring member 33. The latching work of the spring end portion 33*a* to the latching portion 53 can also be simply performed by the latching structure. According to the configuration, it is possible to more simply perform the assembly work.

(4) In the first lever 31, a circumferential wall section 50 is formed, which extends in a circumferential direction on the outer side in the radial direction of the rotating shaft M1. The circumferential wall section 50 surrounds the outer side of the spring member 33 in the radial direction and thereby, forms an accommodation section 51 of the spring member 33 between the second lever 32 and the circumferential wall section 50. The latching portion 53 is formed by notching the circumferential wall section 50.

According to the configuration, it is possible to prevent a foreign substance (for example, dust, dirt, or the like) from coming into contact with the spring member 33 and to secure a safe movement. By using the circumferential wall section 50, it is possible to simply form the latching portion 53 that has a desirable latching structure.

(5) The rotating shaft M1 is formed by inserting a shaft 46 provided on the second lever 32 as the engagement-side lever piece into a through-hole 45 provided on the first lever 31 as the latching-side lever piece. In addition, when the shaft 46 is inserted into the through-hole 45, the step section 48 that comes into contact with a facing surface (surface Sa) of the first lever 31 and is slidable on the facing surface is provided in the second lever 32. The side-end surface 48*s* of the step section 48 forms the contact portion 36 on the second lever 32 side.

According to the configuration, when the assembly is performed, it is possible to safely cause both the first lever 31 and the second lever 32 to relatively rotate against the spring force without causing (both spring end portions 33*a* and 33*b* of) the spring member 33 to be detached. That is, more simply, it is possible to generate the biasing force to the spring member 33 in the direction in which the contact portions 35 and 36 of both the first lever 31 and the second lever 32 are caused to come into contact with each other. In addition, in a relatively rotating position in which the step section 48 which slides on the facing surface of the first lever 31 is detached from the facing surface, an amount of insertion of the shaft 46 is adjusted and positions of both of the contact portions 35 and 36 in the axial direction coincide with each other and thereby, it is possible to cause both of the contact portions 35 and 36 to come into contact with each other based on the biasing force of the spring member 33. In addition, except for the specified assembly position at which both of the contact portions 35 and 36 come into contact with each other, it is not possible to be temporarily assembled because of interference of both the first lever 31 and the second lever 32 with each other. That is, it is possible to prevent an occurrence of erroneous assembly. Accordingly, it is possible to further simplify the assembly work.

(6) In the locking lever 30, both spring end portions 33*a* and 33*b* are configured not to protrude from an outline of both of the first lever 31 and the second lever 32 when viewed in the axial direction of the rotating shaft M1. According to the configuration, both of the spring end portions 33*a* and 33*b* are unlikely to interfere with a component other than the first lever 31 and the second lever 32. Accordingly, it is possible to further simplify the assembly work and it is possible to secure higher safety.

(7) An engagement protrusions 55 is provided in the shaft 46, which can control the axial movement of the shaft 46 in a direction to pull out from the through-hole 45 by engaging with the circumferential edge section of the through-hole 45 at an insertion position at which the contact portions 35 and 36 of the first lever 31 and the second lever 32 are connected to each other.

According to the configuration, it is possible to connect the first lever 31 and the second lever 32 undetachably in the axial direction of the rotating shaft M1 by only inserting the shaft 46 in the through-hole 45. Thus, it is possible to simplify the assembly work.

(8) The remote control device 11 as the vehicle door opening-closing device further includes the base bracket 20 that is fixed to an inner panel 13 of the sliding door 1 as a vehicle door. In addition, the through-hole 65 as the holding section 64 that is able to hold connectors C (C1 and C2) of a wiring harness 63 routed in the sliding door 1 is formed in the base bracket 20.

According to the configuration, even in a case where there is a reason that it is not possible to form the holding section in the inner panel 13, it is possible to safely hold (the connector C of) the wiring harness 63. In addition, the remote control device 11 is attached to the inner panel 13 in a state in which (connector C of) the wiring harness 63 is held (clamped) in the holding section 64 provided in the base bracket 20 and thereby, there is a problem in that a work space is not secured in the sliding door 1; however, it is possible to remove such problem. Further, the through-hole 65 is used as the holding section 64 and then, it is possible to hold the connectors C (C1 and C2) of the wiring harness 63 reliably without an additional new component.

The embodiment described above may be modified as follows.

In the embodiment described above, the locking lever 30 of the remote control device 11 provided in the sliding door 1 is embodied; for example, the configuration may be applied to the locking lever of the vehicle door opening-closing device provided in a slide-type vehicle door.

The configurations of the lever members 10 forming the remote control device 11, a relationship between the lever members 10 and the locking lever 30 may be arbitrarily modified.

In the embodiment described above, the first lever 31 configures the latching-side lever piece which has the latching portion 53 and the second lever 32 configures the engagement-side lever piece that has the engagement surface 54*s*. However, the configuration is not limited thereto, the first lever 31 may configure the engagement-side lever piece and the second lever 32 may configure the latching-side lever piece. Thus, both the first lever 31 and the second lever 32 may be configured to have the engagement surface 54*s* with which the spring end portion comes into contact in the circumferential direction of the rotating shaft M1.

In the embodiment described above, the torsion coil spring 47 is used as the spring member 33; however, for example, another spring member such as a curved leaf spring may be used so as to extend about the rotating shaft M1 of the first lever 31 and the second lever 32.

In the embodiment described above, the spring member 33 of which both of the spring end portions 33*a* and 33*b* extend in the radial direction is used. However, the configuration is not limited thereto; only one spring end portion may extend in the radial direction. That is, the configuration of the latching portion of the latching-side lever piece may be arbitrarily modified. For example, a labyrinthine structure different from the embodiment described above may be used. Thus, even a configuration in which the latching portion is a hole into which the spring end portion bent in the axial direction is inserted is not excluded.

In addition, in the embodiment described above, the shaft 46 provided in the second lever 32 as the engagement-side lever piece is inserted into the through-hole 45 provided in the first lever 31; however, a configuration in which the shaft 46 is provided in the first lever 31 and the through-hole 45 may be formed in the second lever 32 may be employed. Thus, a configuration in which an insertion hole is formed, into which an axis-shaped member which configures the rotating shaft M1 in both the first lever 31 and the second lever 32 is inserted, may be employed.

In the embodiment described above, the engagement protrusion 54 (engagement surface 54*s*) on the second lever 32 side is formed on the rear surface Sb side of the overhanging section 32*c* which protrudes toward a direction opposite to the lever main body 32*b* across the rotating shaft M1. However, the configuration is not limited thereto; however, a position of forming the engagement surface 54*s* may be arbitrarily altered.

For example, as the locking lever 30B illustrated in FIG. 16, FIGS. 17A and 17B, FIGS. 18A and 18B, a configuration may be employed, in which the engagement surface 54*s* is provided in the vicinity of the contact portion 36 on a second lever 32B. Specifically, in the second lever 32B, the engagement surface 54*s* is set as the side-end surface 48*s*' of the step section 48B which is positioned on the rear side in the circumferential direction with respect to the side-end surface 48*s* of the step section 48B that configures the contact portion 36.

Even in such a configuration, in the same procedure as in the locking lever 30 of the embodiment described above, it is possible to simply assemble a first lever 31B, the second lever 32B, and the spring member 33. Thus, the engagement surface 54*s* of the second lever 32B is in the vicinity of the contact portion 36, more simply, it is possible for the contact portion 36 to come into contact with the contact portion 35 on the first lever 31B.

Further, the position of forming the latching portion of the latching-side lever piece may also be arbitrarily altered. Thus, a configuration in which both of the spring end portions may be configured to protrude from the outline of both of the lever pieces may not be excluded.

In the embodiment described above, the through-hole 65 formed on the base bracket 20 of the remote control device 11 is used as the holding section 64 which holds the connectors C (C1 and C2) of the wiring harness 63. However, the configuration is not limited thereto; however, the configuration of the holding section 64 may be arbitrarily altered.

In addition, in the embodiment described above, the first connector C1 provided on the distal end of the first connection line 63*a* extending from the power sliding door device 60 engages with the through-hole 65 that configures the holding section 64; however, a configuration may be employed, in which the second connector C2 provided on the distal end of the second connection line 63*b* extending from the switch unit 61 engages with the through-hole 65 that configures the holding section 64. Thus, even a configuration in which such a holding section 64 is not provided is not excluded.

In the embodiment described above, the wiring harness 63 electrically connects the switch unit 61 provided in the outside door handle 3*b* and the power sliding door device 60; however, the usage of the wiring harness 63 held in the holding section 64 is not necessarily limited thereto.

Next, technical ideas which can be understood from the embodiment described above will be described with effects.

(A) In a locking lever, an engagement protrusion is formed in the shaft, the engagement protrusion being able to control the axial movement of the shaft in a direction in which the shaft is pulled out from the through-hole by engaging with a circumferential edge section of the through-hole at an insertion position at which the contact portions of both lever members can come into contact with each other.

In the configuration described above, it is possible to connect both of the lever pieces undetachably in the axial direction of the rotating shaft only by inserting the shaft into the through-hole. Accordingly, it is possible to more simplify the assembly work.

It is preferable that a locking lever according to an aspect of the disclosure includes: a pair of lever pieces connected to each other to be relatively rotatable; and a spring member which extends about rotating axes of the lever pieces, of which both end portions engage with the lever pieces, and thereby, which biases the lever pieces to rotate in opposite directions, contact portions, which come into contact with each other based on a biasing force of the spring member and thereby, are able to relatively hold rotating positions of the lever pieces, are provided in the lever pieces, respectively, the spring member has spring end portions extending in a radial direction of the rotating shaft, and an engagement surface with which the spring end portion comes into contact in a circumferential direction of the rotating shaft is provided on at least one of the lever pieces.

According to this configuration, both lever pieces are caused to relatively rotate and thereby, it is possible to easily engage the spring end portion of the spring member to the lever piece having the engagement surface. Further, both of the lever pieces are caused to relatively rotate in a state in which the spring end portion comes into contact with the engagement surface, torsion is applied to the spring member, and thereby, it is possible to generate the biasing force to the spring member in a direction in which both of the lever pieces are caused to rotate in a direction opposite to the relatively rotating directions, that is, the biasing force in a direction in which the contact portions of both lever pieces come into contact with each other. In addition, at this time, the spring end portion comes into contact with the engagement surface in the circumferential direction and thereby, there is an advantage in that the spring end portion is unlikely to be detached from the engagement surface. Accordingly, the assembly work becomes simple and it is possible to improve work efficiency.

In the locking lever according to the aspect of the disclosure, it is preferable that both spring end portions of the spring member extend in the radial direction.

According to this configuration, it is possible to eliminate the task of verifying the front and rear relationship, that is, which spring end portion corresponds to which lever piece. Accordingly, it is possible to further simplify the assembly work.

In the locking lever according to the aspect of the disclosure, it is preferable that one of the lever pieces is a latching-side lever piece which has a latching portion on which the one side of the spring end portion is latched and the other of the lever pieces is an engagement-side lever piece which has an engagement surface and engages with the other side of the spring end portion, and the latching portion has a latching mechanism in which it is possible to insert the spring end portion in the axial direction of the rotating shaft and it is possible to prevent the spring end portion from being detached in the axial direction.

According to this configuration, the one spring end portion is latched to the latching-side lever piece not to be separable when assembly is performed and it is possible to safely hold the spring member. The latching work of the spring end portion to the latching portion can also be simply performed by the latching structure. According to the configuration, it is possible to more simply perform the assembly work.

In the locking lever according to the aspect of the disclosure, it is preferable that a circumferential wall section is formed in the latching-side lever piece, extends in a circumferential direction on the outer side of the rotating shaft in the radial direction, and thereby, forms an accommodation section of the spring member between the engagement-side lever piece and the circumferential wall section, and the latching portion is formed by notching the circumferential wall section.

According to this configuration, it is possible to prevent a foreign substance (for example, dust, dirt, or the like) from coming into contact with the spring member and to secure a safe movement. By using the circumferential wall section, it is possible to simply form the latching portion that has a desirable latching structure.

In the locking lever according to the aspect of the disclosure, it is preferable that the rotating shaft is formed by inserting a shaft provided on the one side of the lever piece into a through-hole provided on the other side of the lever piece. In addition, it is preferable that, when the shaft is inserted into the through-hole, a step section that comes into contact with a facing surface of the latching-side lever piece and is slidable on the facing surface is formed in the engagement-side lever piece and a side-end surface of the step section forms the contact portion.

According to this configuration, when the assembly is performed, it is possible to cause both of the lever pieces to relatively rotate in a safe manner against the spring force without causing (both spring end portions of) the spring member to be detached. That is, more simply, it is possible to generate the biasing force to the spring member in the direction in which the contact portions of both of the lever pieces are caused to come into contact with each other. In addition, in a relatively rotating position in which the step section which slides on the facing surface of the latching-side lever piece is detached from the facing surface, an amount of insertion of the shaft is adjusted and positions of both of the contact portions in the axial direction coincide with each other and thereby, it is possible to cause both of the contact portions to come into contact with each other based on the biasing force of the spring member. In addition, except for the specified assembly position at which both of the contact portions come into contact with each other, it is not possible to be temporarily assembled because of interference from both of the lever pieces. That is, it is possible to prevent an occurrence of erroneous assembly. Accordingly, it is possible to further simplify the assembly work.

In the locking lever according to the aspect of the disclosure, it is preferable that both spring end portions do not protrude from an outline of both of the lever pieces when viewed in the axial direction of the rotating shaft.

According to this configuration, both of the spring end portions are unlikely to interfere with a component other than the lever pieces. Accordingly, it is possible to further simplify the assembly work and it is possible to secure a higher level of safety.

It is preferable that a vehicle door opening-closing device according to another aspect of the disclosure includes: the locking lever according to the aspect of this disclosure.

According to this configuration, the assembly work is simplified and it is possible to improve the work efficiency.

It is preferable that the vehicle door opening-closing device according to the aspect of the disclosure further includes a base bracket that is fixed to an inner panel of a vehicle door. In addition, it is preferable that a holding section that is able to hold a connector of a wiring harness routed in the vehicle door is formed in the base bracket.

According to this configuration, even in a case where there is a reason that it is not possible to form the holding section in the inner panel, it is possible to safely hold (the connector of) the wiring harness.

According to the aspects of this disclosure, assembly of a locking lever is simplified and it is possible to improve work efficiency.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A locking lever comprising:

a pair of lever pieces including a latching-side lever piece and an engagement-side lever piece connected to each other to be relatively rotatable; and a spring member which extends about a rotating shaft of the lever pieces, in engagement with the lever pieces, and thereby, which biases the lever pieces to rotate in opposite directions, wherein the spring member has a pair of spring end portions extending radially with respect to the rotating shaft, wherein the rotating shaft is formed by inserting a shaft provided on one of the latching-side lever piece or the engagement-side lever piece into a through-hole provided on an other of the latching-side lever piece or the engagement-side lever piece, wherein the latching-side lever piece has a latching portion on which one of the spring end portions is latched, wherein the engagement-side lever piece has an engagement surface with which an other of the spring end portions comes into contact in a circumferential direction of the rotating shaft, wherein, when the shaft is inserted into the through-hole, a facing surface of the engagement-side lever piece faces and comes into sliding contact with a facing surface of the latching-side lever piece, and wherein, when the engagement-side lever piece and the latching-side lever piece are rotated relative to each other and when the facing surfaces of the engagement-side lever piece and the latching-side lever piece are detached, an insertion amount of the shaft becomes adjustable so that a step section of the engagement-side lever piece, which is contiguous with the facing surface of the engagement-side lever piece, and a side-end surface of the latching-side lever piece, which is contiguous with the facing surface of the latching-side lever piece, contact each other based on a biasing force of the spring member and thereby, are able to hold a relatively rotating position of the lever pieces.

2. The locking lever according to claim 1, wherein a circumferential wall section is formed in the latching-side lever piece, extends in a circumferential direction on the outer side of the rotating shaft in the radial direction, and thereby, forms an accommodation section of the spring member between the engagement-side lever piece and the circumferential wall section, and wherein the latching portion comprises an open section of the circumferential wall section that extends in an axial direction and has a protrusion portion where the one of the spring end portions rests.

3. The locking lever according to claim 1, wherein both spring end portions do not protrude from an outline of both of the lever pieces when viewed in the axial direction of the rotating shaft.

4. A vehicle door opening-closing device comprising:

the locking lever according to claim 1.

5. The vehicle door opening-closing device according to claim 4, further comprising:

a base bracket that is fixed to an inner panel of a vehicle door, wherein a holding section that is able to hold a connector of a wiring harness routed in the vehicle door is formed in the base bracket.

6. A method of assembling a locking lever, the locking lever having a pair of lever pieces including a latching-side lever piece and an engagement-side lever piece connected to each other to be relatively rotatable, and a spring member which extends about a rotating shaft of the lever pieces, in engagement with the lever pieces, and thereby, which biases the lever pieces to rotate in opposite directions, wherein the spring member has a pair of spring end portions extending radially with respect to the rotating shaft, the latching-side lever piece has a latching portion on which one of the spring end portions is latched, and the engagement-side lever piece has an engagement surface with which an other of the spring end portions comes into contact in a circumferential direction of the rotating shaft, the method comprising:

latching the one of the spring end portions to the latching portion of the latching-side lever piece;

inserting a shaft provided on one of the latching-side lever piece or the engagement-side lever piece into a through-hole provided on an other of the latching-side lever piece or the engagement-side lever piece to form the rotating shaft, wherein, when the shaft is inserted into the through-hole, a facing surface of the engagement-side lever piece faces and comes into sliding contact with a facing surface of the latching-side lever piece;

rotating the engagement-side lever piece and the latching-side lever piece relative to each other to detach the facing surfaces of the engagement-side lever piece and the latching-side lever piece are detached; and adjusting an insertion amount of the shaft so that a step section of the engagement-side lever piece, which is contiguous with the facing surface of the engagement-side lever piece, and a side-end surface of the latching-side lever piece, which is contiguous with the facing surface of the latching-side lever piece, come into contact each other based on a biasing force of the spring member and thereby, are able to hold a relatively rotating position of the lever pieces.

* * * * *